US006298516B1

(12) United States Patent
Beals et al.

(10) Patent No.: US 6,298,516 B1
(45) Date of Patent: Oct. 9, 2001

(54) TOOTHBRUSHES

(75) Inventors: Donna Beals, Sunnyvale; Max Yoshimoto, San Francisco; Jeffrey Allen Salazar, Belmont; William A. Bredall, Pacifica; Thomas Craig Masterman, San Francisco, all of CA (US)

(73) Assignee: Gillette Canada Company, Halifax (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/569,002

(22) Filed: May 11, 2000

Related U.S. Application Data

(63) Continuation-in-part of application No. 09/428,809, filed on Oct. 28, 1999, which is a continuation of application No. 09/036,379, filed on Mar. 6, 1998, now abandoned.

(51) Int. Cl.[7] ..... A46B 5/02
(52) U.S. Cl. ..... 15/143.1; 15/167.1; 433/216
(58) Field of Search ..... 15/143.1, 167.1; 433/216

(56) References Cited

U.S. PATENT DOCUMENTS

| | | | |
|---|---|---|---|
| 128,840 | | 7/1872 | Allerton . |
| D. 142,917 | | 11/1945 | Strieby . |
| D. 345,054 | | 3/1994 | Spence, Jr. . |
| D. 350,851 | | 9/1994 | Spence, Jr. . |
| 1,075,171 | | 10/1954 | Darcissic . |
| 1,251,250 | | 12/1917 | Libby . |
| 1,421,098 | | 6/1922 | Phillips . |
| 1,657,450 | | 1/1928 | Barnes . |
| 1,796,001 | | 3/1931 | Church . |
| 1,899,242 | * | 2/1933 | McNab . |
| 1,924,152 | | 8/1933 | Coney et al. . |
| 2,139,245 | | 12/1938 | Ogden . |
| 2,263,885 | | 11/1941 | McGauley . |
| 2,267,670 | | 12/1941 | Rosenwasser . |
| 3,553,759 | | 1/1971 | Kramer et al. . |
| 4,033,008 | | 7/1977 | Warren et al. . |
| 4,283,808 | * | 8/1981 | Beebe . |
| 4,288,883 | | 9/1981 | Dolinsky . |
| 4,356,585 | | 11/1982 | Protell et al. . |
| 4,403,623 | | 9/1983 | Mark . |
| 4,472,853 | | 9/1984 | Rauch . |
| 4,616,374 | | 10/1986 | Novogrodsky . |
| 4,617,694 | | 10/1986 | Bori . |
| 4,672,706 | | 6/1987 | Hill . |
| 4,852,202 | | 8/1989 | Ledwitz . |
| 4,882,803 | | 11/1989 | Rogers et al. . |
| 4,894,880 | | 1/1990 | Aznavoorian . |
| 5,114,214 | | 5/1992 | Barman . |
| 5,291,878 | | 3/1994 | Lombardo et al. . |
| 5,630,244 | | 5/1997 | Chang . |
| 5,778,478 | | 7/1998 | Coleman . |
| 5,781,958 | | 7/1998 | Meessmann et al. . |

FOREIGN PATENT DOCUMENTS

| | | | |
|---|---|---|---|
| 28 40 429 A | | 9/1978 | (DE) . |
| 41 136 A1 | | 4/1991 | (DE) . |
| 295 01 338 U1 | | 6/1995 | (DE) . |
| 2050156 | * | 11/1981 | (GB) . |
| 2167995 | * | 6/1986 | (GB) . |
| 226526 | | 5/1969 | (SE) . |
| WO 96/21400 | | 7/1996 | (WO) . |

* cited by examiner

*Primary Examiner*—Randall E. Chin
(74) *Attorney, Agent, or Firm*—Fish & Richardson P.C.

(57) ABSTRACT

A toothbrush is provided that includes a body and a brush head extending from the body, the body including a handle having a distal end, and a resilient element mounted on the handle, a tapered distal tip of the resilient element extending beyond the distal end of the handle.

28 Claims, 10 Drawing Sheets

TOOTHBRUSHES

This application is a continuation-in-part of U.S. Ser. No. 09/428,809, filed Oct. 28, 1999, now pending which is a continuation of U.S. Ser. No. 09/036,379, filed Mar. 6, 1998 and now abandoned.

BACKGROUND OF THE INVENTION

The invention relates to toothbrushes.

It is well known that frequent and thorough toothbrushing is important in order to keep the teeth and gums clean and healthy. Therefore, it is desirable that a toothbrush be as comfortable to use as possible. Due to differences in hand size and shape and brushing style, a toothbrush design that seems comfortable to one user may not seem comfortable to another user.

SUMMARY OF THE INVENTION

The present invention features toothbrushes that provide good comfort to users having a wide variety of hand shapes and sizes and brushing styles. The toothbrushes provide a user with a secure, comfortable grip as the user moves the toothbrush around in his hand, and have a relatively soft end that cushions the user's palm from uncomfortable contact with the end of the toothbrush handle. This toothbrush design is particularly helpful in increasing the comfort of toothbrush users whose palms frequently contact the end of the toothbrush handle during brushing, for example users who grip their toothbrush as if it were a spoon. These comfortable toothbrush designs may lead to increased brushing times, and/or more frequent brushing, and an associated health benefit. Preferred toothbrushes of the invention are durable and relatively simple to manufacture, and are aesthetically attractive.

In one aspect, the invention features a toothbrush that includes a body and a brush head extending from the body, the body including a handle having a distal end, and a resilient element mounted on the handle, a tapered distal tip of the resilient element extending beyond the distal end of the handle. In preferred brushes, the tapered distal tip provides a cushioning contact with a user's hand when the toothbrush is in use.

Preferred implementations include one or more of the following features. The body is contoured to provide a finger-gripping region, and a palm-gripping region having a relatively larger diameter than the finger-gripping region. The resilient element comprises a resilient material selected from the group consisting of thermoplastic elastomers, closed cell foams, resilient urethanes and silicones. The resilient element comprises a thermoplastic elastomer selected from the group consisting of thermoplastic vulcanates (rubber polyolefin blends), polyetheramides, polyesters, styrene-ethylene-butylene-styrene (SEBS) block copolymers, styrene-butadiene-styrene block copolymers, partially or fully hydrogenated styrene-butadiene-styrene block copolymers, styrene-isoprene-styrene block copolymers, partially or fully hydrogenated styrene-isoprene-styrene block copolymers, polyurethanes, polyolefin elastomers, polyolefin plastomers, styrenic based polyolefin elastomers, and compatible mixtures thereof. The thermoplastic elastomer includes a styrene-ethylene-butylene-styrene block copolymer. The length of the distal tip is about 0.025 to 2.0 inches. The resilient member comprises a resilient material having a hardness of from about 3 to 90 Shore A. The resilient member comprises a resilient material having a tensile modulus of at least 50 psi (measured using ASTM D-412, tensile modulus at 300% elongation). The resilient member comprises a resilient material having a tear strength of at least 50 pli (measured using ASTM D 624, Die C). The distal tip is generally oval or elliptical in cross-section. The circumference of the body is largest at the approximate midpoint between the finger-gripping region and the distal end of the handle. The largest thickness of the body is about 0.5 to 1.0 inches. The largest thickness of the body is located about 1.5 to 3 inches from the approximate midpoint of the finger-gripping region. The body is generally bulbous shaped, or, alternatively, the body is generally hour-glass shaped. The body is shaped and dimensioned to fit into a user's unstrained, natural grip, i.e., the shapes of the opening defined by the fingers when the hand is held in a loosely closed position. The resilient element provides a gripping surface for the palm of the user's hand during use. The toothbrush further includes a second resilient element constructed to provide a grip for the user's thumb and index finger during use.

In another aspect, the invention features a toothbrush that includes a body and a brush head extending from the body, the body including a handle having a distal end, and a resilient element mounted on the handle, a distal tip of the resilient element extending beyond the distal end of the handle to provide a cushioning contact with a user's hand when the toothbrush is in use, the resilient member having a tensile modulus of from about 50 to 1500 psi.

In a further aspect, the invention features a toothbrush that includes a body, a brush head extending from the body, and a neck between the body and brush head, the body including a handle having a distal end, and a resilient element mounted on the handle, a distal tip of the resilient element extending beyond the distal end of the handle to provide a cushioning contact with a user's hand when the toothbrush is in use, the circumference of the body being greatest at a location intermediate the neck and the distal end, and tapering to a relatively smaller circumference at the neck and distal end.

The invention also features methods of brushing the teeth using toothbrushes of the invention.

Other features and advantages of the invention will be apparent from the following description of a presently preferred embodiment, and from the claims.

DESCRIPTION OF THE PREFERRED EMBODIMENTS

Figure 1:
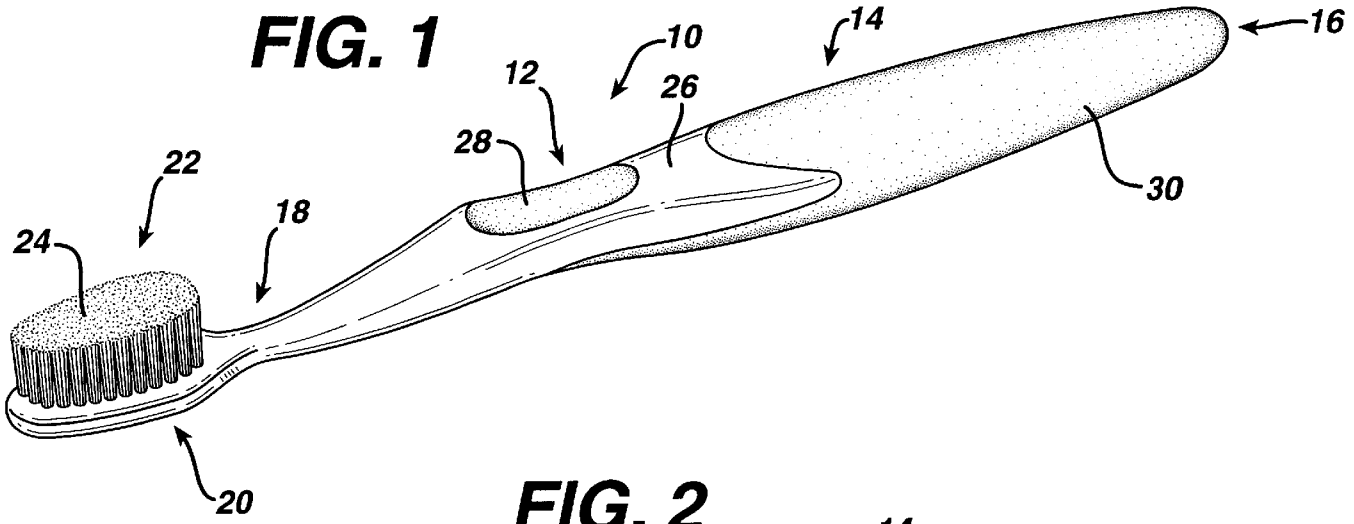
FIG. 1 is a perspective view of a toothbrush according to one embodiment of the invention.

Referring to FIG. 1, a toothbrush 10 includes a rigid handle 26 that defines a finger-gripping region 12 and a palm-gripping region 14. The toothbrush also includes a distal end 16, a neck 18, and a head 20 :hat includes a brush portion 22 including a plurality of bristles 24.

The finger-gripping and palm-gripping regions 12, 14 are cushioned, for a more comfortable and secure grip. Thus, a finger-gripping resilient element: 28 is provided in the finger-gripping region 12 of the handle, and a palm-gripping resilient element 30 is provided in the palm-gripping region 14 of the handle. These resilient elements are generally flush with the surrounding surface of the handle 26, as shown.

Figure 2:
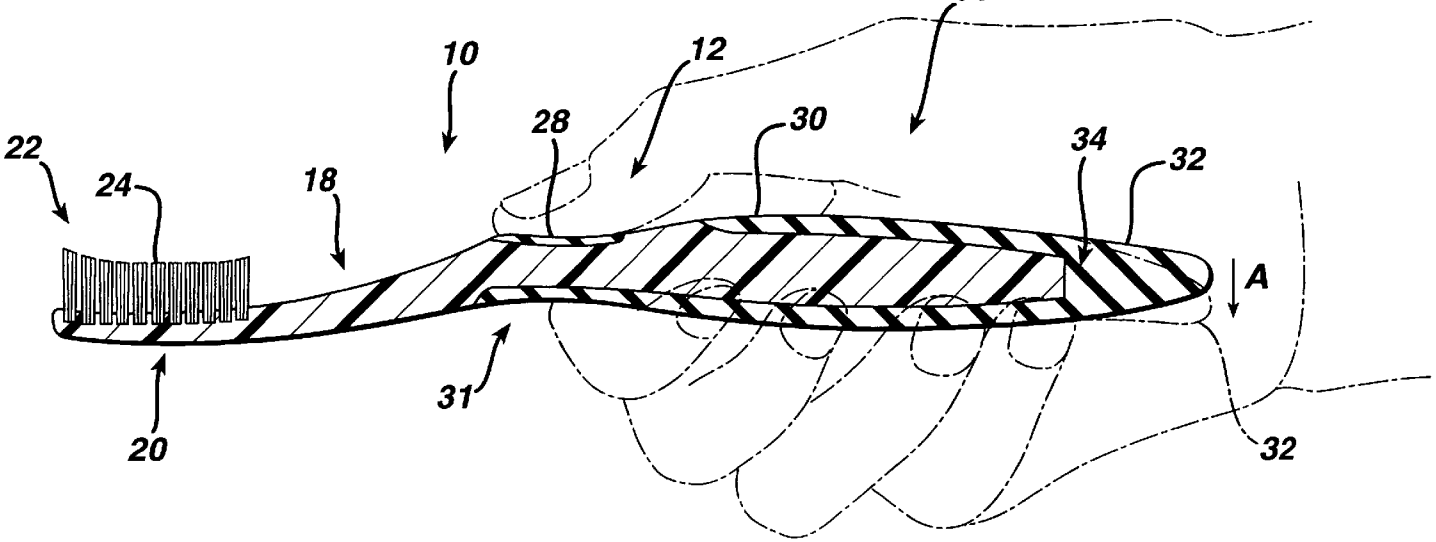
FIG. 2 is a cross-sectional view of the toothbrush of FIG. 1, showing the hand of a user in phantom lines.

The palm-gripping resilient element 30 serves two purposes. First, it provides a comfortable surface for gripping between the palm and fingers that generally has a relatively non-slippery surface to give a secure-feeling grip. Second, as shown in FIGS. 2 and 2A, a tapered distal tip 32 of resilient element 30 extends beyond the distal end 34 of the underlying handle 26, to cushion the palm or heel of the user's hand from uncomfortable contact with the hard end 34. This distal tip 32 provides comfort when the user is maneuvering the toothbrush around in the mouth or applying pressure to the brush head, actions that typically result in contact between the distal end of the toothbrush and the palm or heel of the user's hand. The distal tip 34 also flexes (arrow A and dotted line, FIG. 2) to accommodate the curvature of the heel of the hand, and to allow the end of the toothbrush body to move about in the hand without causing user discomfort. In particular, when some users move the brush to change from brushing one side of the mouth to the other, the end of the toothbrush body tends to press into the palm of the user's hand, an occurrence that is made more comfortable by the soft distal tip 32.

The finger-gripping region 12 is cushioned for more comfortable, secure gripping between the thumb and index finger. This cushioning is provided by resilient element 28, together with the front portion 31 of resilient element 30 (the portion that is located on the opposite side of the handle 26 from resilient element 28). Again, the resilient elements generally provide a non-slippery gripping area, and give the handle a softer feel during brushing.

The contour and dimensions of the toothbrush also enhance user comfort, and therefore may improve brushing time in some users, with resulting health benefits. The contour and dimensions are generally selected so that the shape of the toothbrush body will correspond approximately to the average shape of the opening that is defined by the fingers when a human hand is held in a relaxed gripping position. The dimensions and angles that define the preferred contour will be defined below with reference to the following reference system.

Reference System/Definitions

Figure 3:
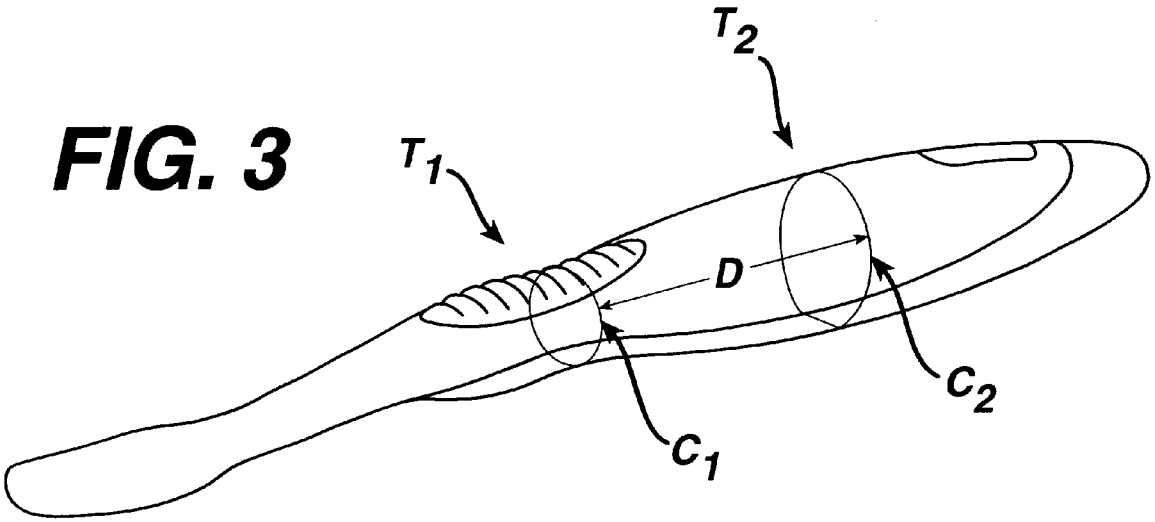
FIGS. 3 and 3A are, respectively, perspective and top views of a toothbrush according to an alternate embodiment of the invention.
Figure 3A:
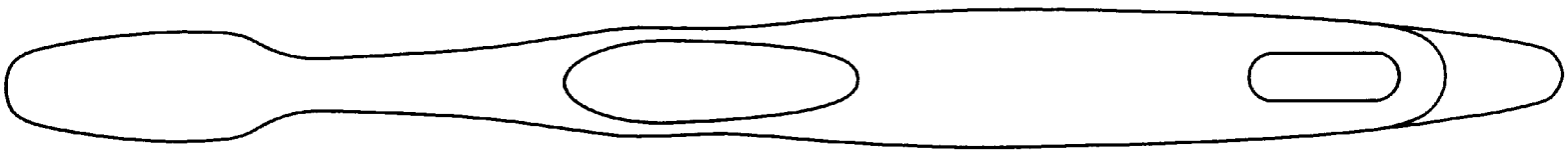
Figure 3B:
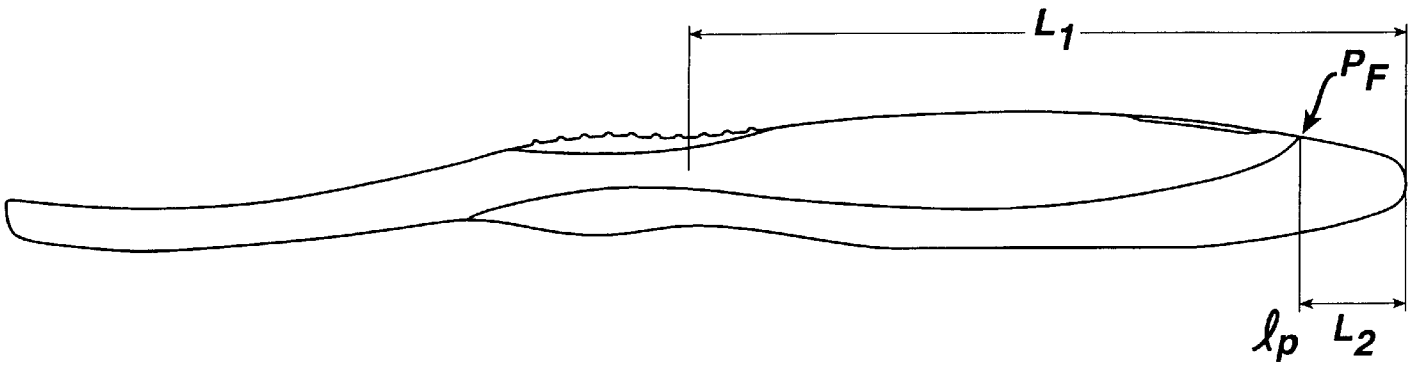
FIGS. 3B, :3C and 3D are side views of the toothbrush.
Figure 3C:
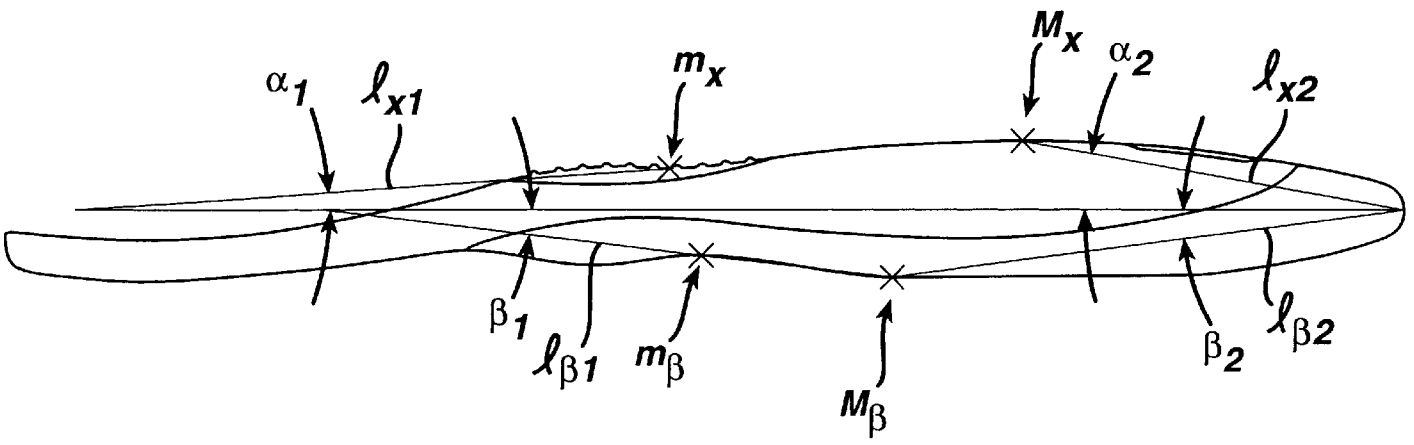
Figure 3D:
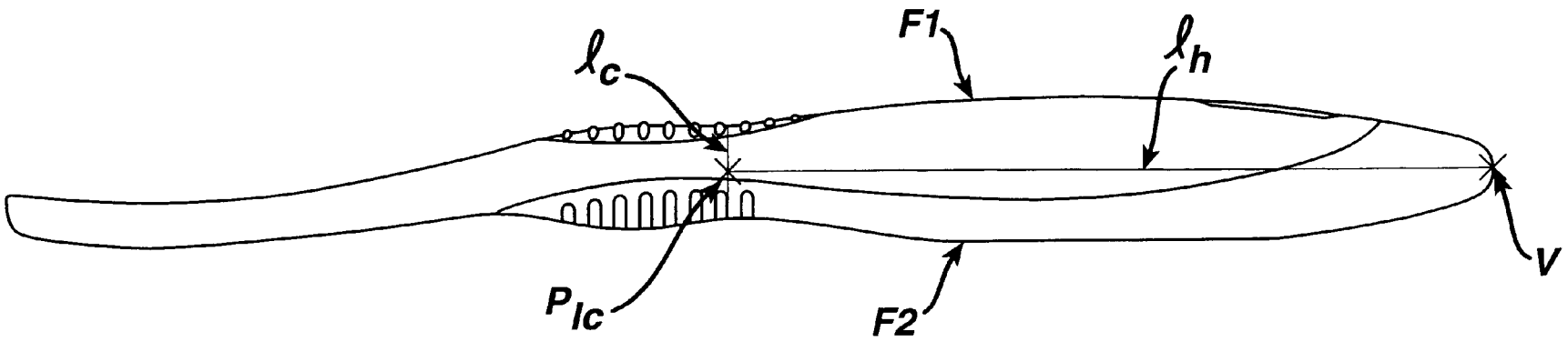

Referring to FIGS. 3–3D, the reference system is set up, and the dimensions and angles are measured, -using the following procedure. A mirror plane, i.e., a plane about which each point from one side can be mapped to a symmetrical point on the other side, to give a frame of reference. It should be understood that for toothbrushes that have minor deviations from symmetry about a mirror plane (e.g., finger gripping ridges on one side of the plane but not the other) these minor deviations are ignored. Similarly, if the toothbrush includes an area at which its curved surface is truncated to define a flat region (e.g., so that the toothbrush will lie flat on a surface), the following calculations are made as if the curved surface were continuous, without this truncation.

SETTING UP THE REFERENCE SYSTEM FOR THE BRUSH

1. Orient the brush so that the handle is facing left to right with the distal end facing right and bristles facing up.
2. Find the mirror plane. Bisect the brush along this plane.
3. View the brush normal to the mirror plane (the side view, e.g., as shown in FIGS. 3*b*–3*d*).
4. Along the mirror plane, two functions(F1, F2) are created representing the two-dimensional contour of the top part of the brush (bristle side) and the bottom part of the brush, respectively.
5. Find the shortest line $l_c$ that is in the mirror plane that connects the to function and the bottom function in the region of the thumb grip. Exclude special brush features such as ridges.
6. Find the center of th is line $P_{lc}$.
7. Find the vertex of the wiggle tip V.
8. Draw a line from $P_{lc}$ to V called $l_h$.
9. Orient $l_h$ horizontally.

MEASURING $\alpha_1$ Find the point in the mirror plane in the region of the thumb grip along the top function where the vertical height above $l_h$ is minimized and call it $m_\alpha$. Find the point in the mirror plane in the region of the grip along the top function where the vertical height above $l_h$ is maximized and call it $M_\alpha$. Drawa a line from $m_\alpha$ to $M_\alpha$ and call it $l_{\alpha 1}$. Measure the angle from line $l_h$ to line $l_{\alpha 1}$ in a counterclockwise direction. This angle is $\alpha_1$.

$\alpha_2$ Draw a line from $M_\alpha$ to V and call it $l_{\alpha 2}$. Measure the angle from line $l_h$ to line $l_{\alpha 2}$ in a clockwise direction. This angle is $\alpha_2$.

$\beta_1$ Find the point in the mirror plane in the region of the thumb grip along the bottom function where the vertical height above $l_h$ is minimized and call it $m_\beta$. Find the point in the mirror plane in the region of the grip along the bottom function where the vertical height above $l_h$ is maximized and call it $M_\beta$. Draw a line from $m_\beta$ to $M_\beta$ and call it $l_{\beta 1}$. Measure the angle from line $l_h$ to line $l_{\beta 1}$ in a clockwise direction, This angle is $\beta_1$.

Draw a line from $M_\beta$ to V and call it $l_{\beta 2}$. Measure the angle of the line $l_{\beta 2}$ relative to line $l_h$ in a counterclockwise direction. This angle is $\beta_2$.

$L_1$ The horizontal distance in the mirror plane along $l_h$ from $l_c$ to vertex V.

$L_2$ The horizontal distance in the mirror plane from a line $l_p$ to the vertex V. Line $l_p$ is perpendicular to $l_h$ and passes through the furthermost distal point of the rigid plastic $P_f$.

$T_1$ Thinnest section. This is the length of the shortest vertical line $l_c$ that connects the top and bottom functions in the region of the finger gripping region, excluding special features such as ridges.

$C_1$ Circumference at the thinnest section. Distance around the surface at $T_1$ in a plane perpendicular to the mirror plane and $l_h$.

$T_2$ Thickest section. Length of the longest vertical line $L_c$, that connects the top and bottom functions in the palm gripping region, excluding special features such as ridges. $C_2$ Circumference at the thickest section. Distance around the surface at $T_2$ in a plane perpendicular to the mirror plane and $l_h$.

Figure 4:
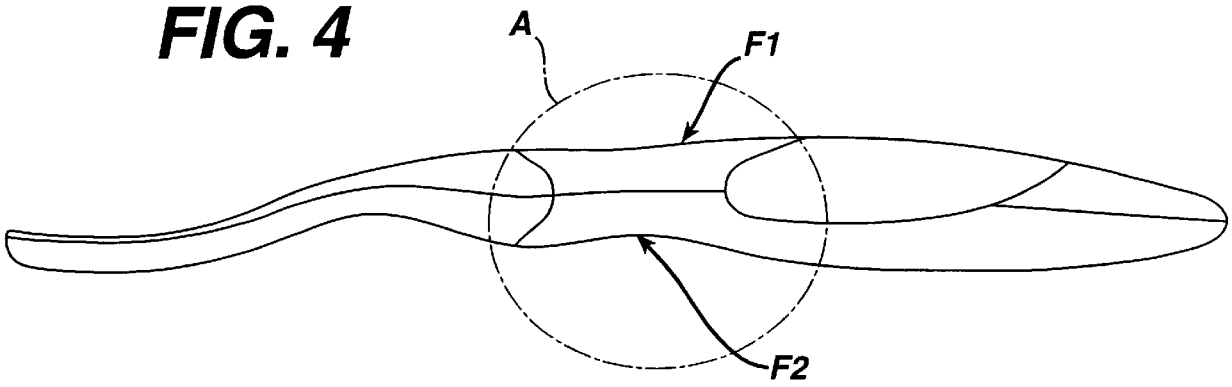
FIG. 4 is an axial cross-sectional view of a toothbrush according to another embodiment of the invention.
Figure 4A:
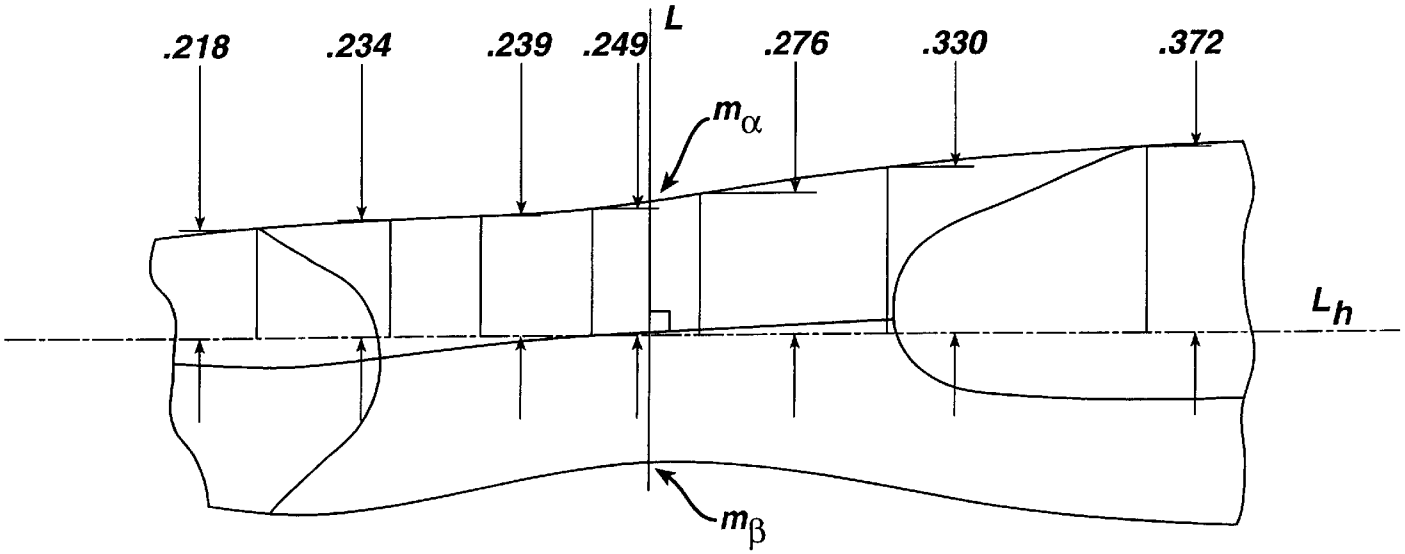
FIG. 4A is a highly enlarged detail view of detail A of FIG. 4.

In the case of some toothbrush shapes, e.g., the shape shown in FIGS. 4–4A, $m_\alpha$ or $m_\beta$ cannot be determined according to the definitions discussed above, because one of the functions F1, F2 does not have a minimum vertical height (e.g., as shown for F1 in FIG. 4A). In the event that $m_\alpha$ cannot be determined according to the definition above, an alternate definition is used, as follows. Find $m_\beta$ as described above, then draw a line L (FIG. 4A) through mp and F1, perpendicular to $l_h$. The intersection of line L with F1 is then taken as $m_\alpha$.

Similarly, if $m_\beta$ cannot be determined according to the definitions discussed above, a line (not shown) is drawn through $m_\alpha$ and F2, perpendicular to $l_h$, and its intersection with F2 is taken as $m_\beta$.

Preferred Dimensions and Angles

Referring to FIG. 3B, the toothbrush handle 26 has a length $L_1$ of about 2.5 to 5 inches, more preferably about 2.5 to 4.5 inches, and most preferably about 2.9 to 4.4 inches. The distal tip 32 has a length $L_2$ of about 0.025 to 3 inches, more preferably about 0.050 to 2.8 inches, and most preferably about 0.1 to 1 inch. If $L_2$ is too short, the desired cushioning effect may not be achieved; if $L_2$ is too long, the user's little finger may grasp the distal tip 32, which may give a feeling of an insecure grip.

The distal tip 32 and distal end of the toothbrush are tapered at an acute angle, to provides a natural, ergonomically correct grip, reducing strain on a user's muscles during brushing. This angle of taper is quantified by $\alpha_2$ and $\beta_2$, as defined above, for the top and bottom surfaces of the toothbrush, respectively. Preferred values for $\alpha_2$ are from about 2 to 20 degrees, more preferably 3 to 12 degrees, and most preferably 5 to 10 degrees. Preferred values for $\beta_2$ are from about 2 to 15 degrees, more preferably 5 to 12 degrees, and most preferably 6.5 to 10.5 degrees.

The distal tip 32 has a generally oval or elliptical shape, in radial cross-section, to fill the space that is defined by the fingers and palm when the user's hand is in its natural closed position (gripping no hing, in a loose fist).

The toothbrush also has a generally bulbous shape, to contour it to fit most shapes and sizes of hands. Thus, the finger-gripping region 12 has a circumference that is slightly larger than the neck 20, to provide a sufficiently large surface area for gripping with the fingers (generally between the thumb and index finger). Preferably, the circumference $C_1$ of the finger-gripping region at its thinnest section ($T_1$, FIG. 3) is from about 0.6 to 3 inches, more preferably about 0.75 to 2.5 inches, and most preferably 1.25 to 2.25 inches. The toothbrush then increases in circumference along its length, providing a large surface area for gripping between the palm and the middle and ring fingers of the user's hand. Preferably, the circumference $C_2$ of the toothbrush at its thickest section ($T_2$, FIG. 3) is from about 1.5 to 3.0 inches, more preferably 1.75 to 2.75 inches, and most preferably 1.75 to 2.5 inches. The thickest section is generally located approximately halfway between the middle of the finger gripping region 12 (generally the location of the thinnest section) and the distal end 34 of handle 26, coinciding roughly with the center of the user's palm. Preferred values for $T_1$, as defined above, are from 0.25 to 0.75 inch, more preferably 0.3 to 0.6 inch, and most preferably 0.4 to 0.5 inch. Preferred values for $T_2$, as defined above, are from 0.5 to 1.0 inch, more preferably 0.6 to 0.9 inch, and most preferably 0.65 to 0.85 inch.

Generally, the distance (D) between the thickest and thinnest sections of the toothbrush is approximately 1.5 to 3 inches. The toothbrush then tapers, along its length, from $T_2$ to $T_1$, to accommodate the smaller circumference opening defined by the user's index finger and palm. The angle of taper is quantified by $\alpha_1$ and $\beta_1$, as defined above, for the top and bottom surfaces of the toothbrush respectively. Preferred values for $\alpha_1$ are from about 2 to 20 degrees, more preferably 3 to 10 degrees, and most preferably 4 to 7.5 degrees. Preferred values for $\beta_1$ are from about 3 to 12 degrees, more preferably 3 to 10 degrees, and most preferably 4 to 6.5 degrees.

Other Features

Preferably, the toothbrush has a total weight of about 10 to 60 grams, more preferably about 15 to 40 grams. If the toothbrush is too heavy, it is not: ergonomically correct and may feel cumbersome to the user; if it is too light, it may be regarded as flimsy and of poor quality.

The head 20 may be any desired shape, e.g., rectangular or oval, diamond shaped, or any other suitable shape, and the brush portion may include, in addition to or instead of bristles, any other desired type of cleaning elements, e.g., fins. The bristles and/or other cleaning elements may be arranged in any desired configuration. One preferred bristle configuration is shown in U.S. Ser. No. 09/177,991, now pending (PCT US 98/23780) the full disclosure of which is incorporated herein by reference.

Figure 5:
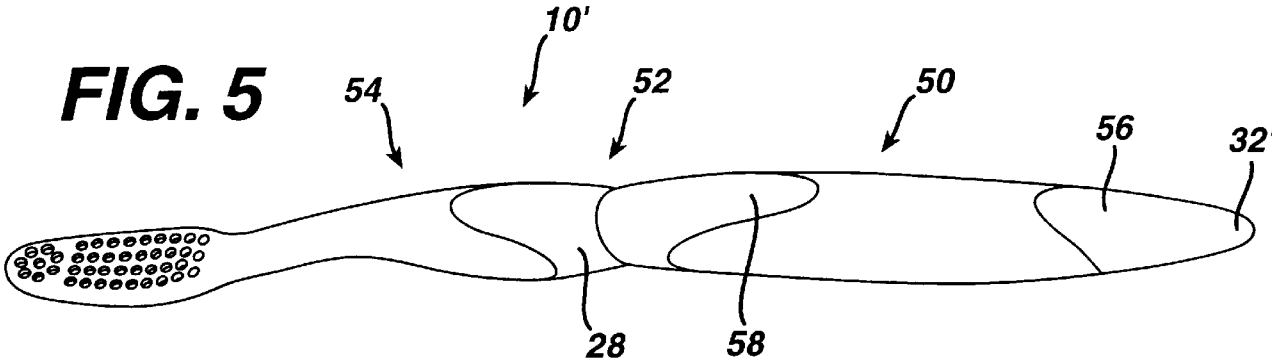
FIGS. 5, 5A and 5B are, respectively, perspective, side and top views of a toothbrush according to an alternate embodiment of the invention, with bristles omitted.
Figure 5A:
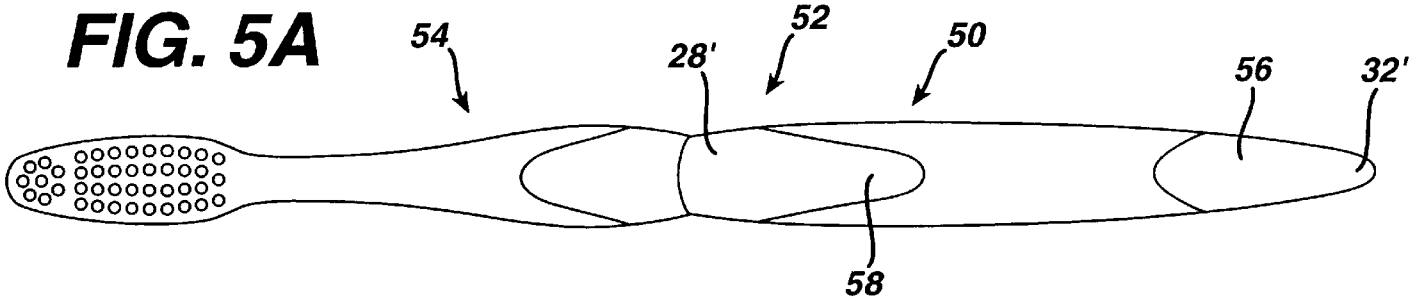
Figure 5B:
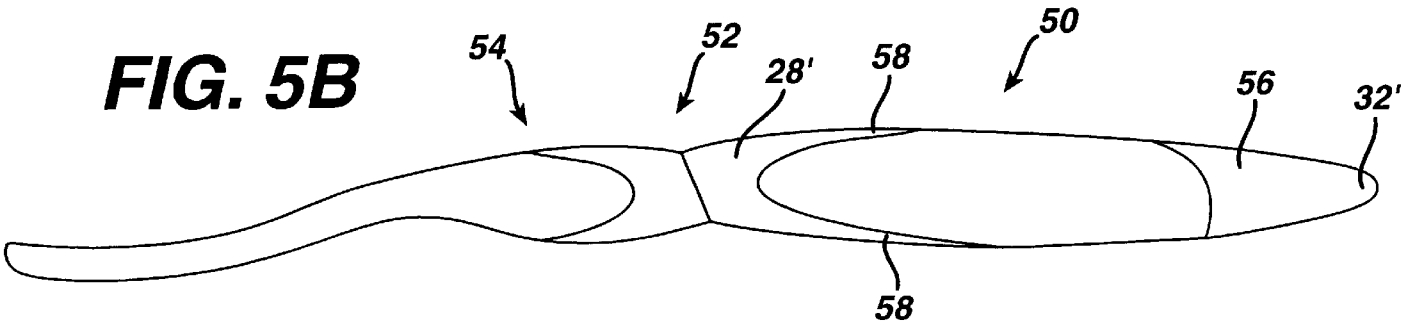
Figure 5C:
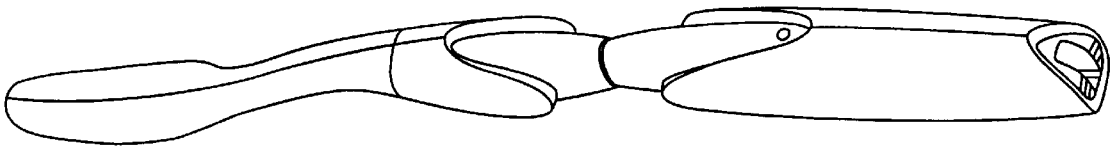
FIGS. 5C, 5D, 5E and 5F are, respectively, perspective, top, side and bottom views of the underlying handles of the toothbrush of FIGS. 5–5B.
Figure 5D:
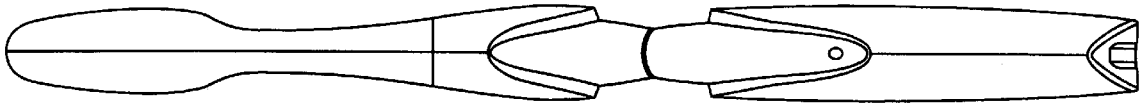
Figure 5E:
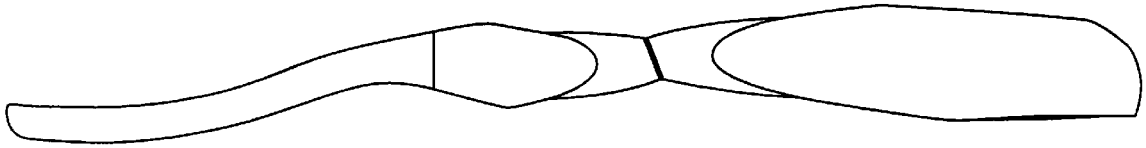
Figure 5F:
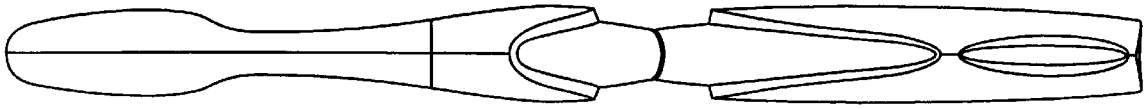
Figure 6:
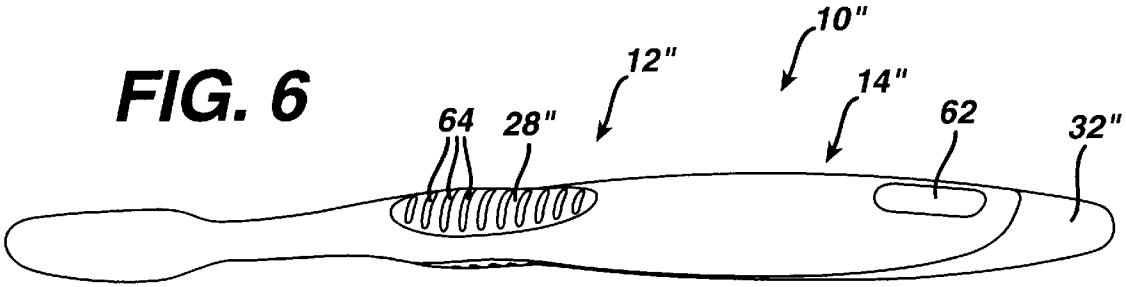
FIGS. 6, 6A and 6B are, respectively, perspective, side and top views of a toothbrush according to another alternate embodiment of the invention, with bristles omitted.
Figure 6A:
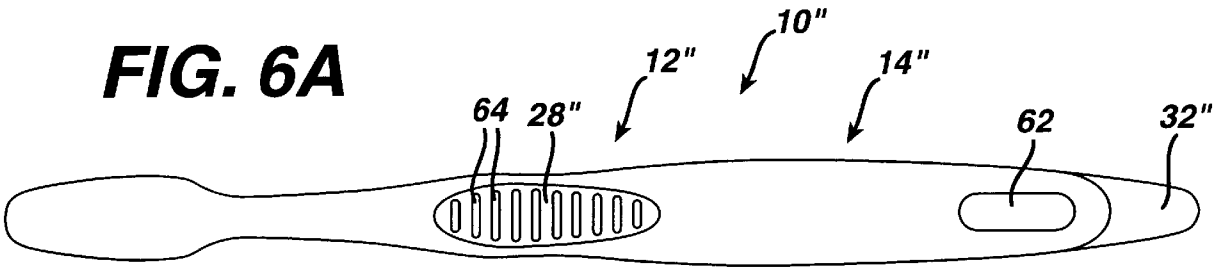
Figure 6B:
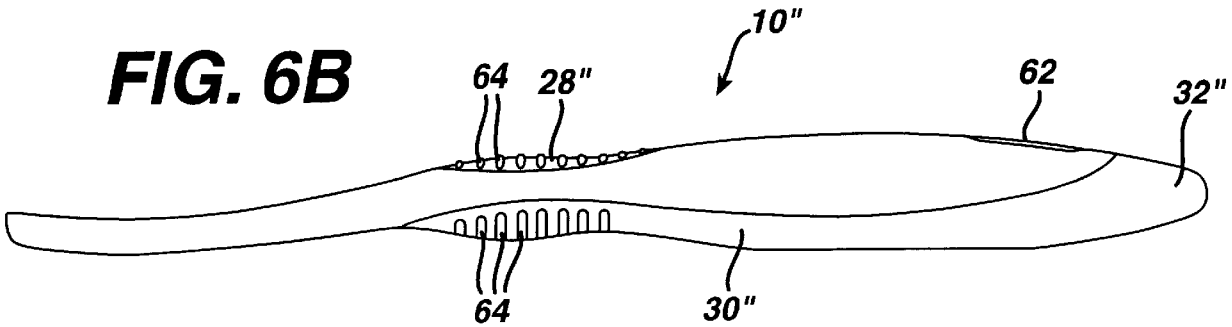
Figure 6C:
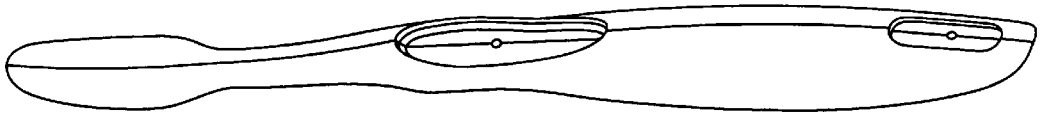
FIGS. 6C, 6D, 6E and 6F are, respectively, perspective, top, side and bottom views of the underlying handle of the toothbrush of FIGS. 6-6B.
Figure 6D:
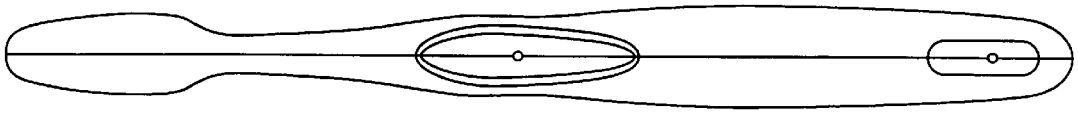
Figure 6E:
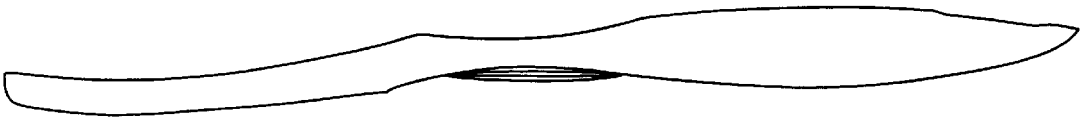
Figure 6F:
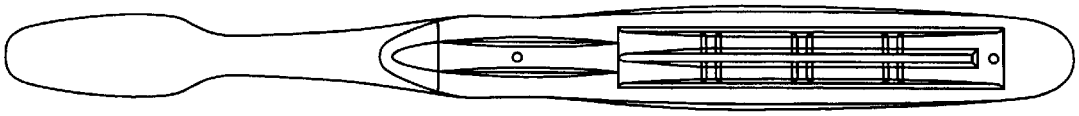

Two other preferred toothbrush shapes are shown in FIGS. 5–5B and 6–6B. The rigid handles on which the resilient portions are mounted are shown for each toothbrush shape, in FIGS. 5C–5F and 6C–6F. Like the toothbrush shown in FIGS. 1–2, these toothbrushes include a soft distal tip 32 and resilient elements to provide a secure and comfortable grip. The toothbrush 10' shown in FIGS. 5–5B is generally hour-glass shaped, with a rear portion 50 that has a bulbous shape as described above, a central finger grip 52, having a relatively small circumference, and a forward portion 54 which is also generally bulbous. This toothbrush is generally symmetrical about its longitudinal axis. This symmetrical, hour-glass shape is advantageous for users who frequently rotate their toothbrushes during use. Toothbrush 10' includes a finger-gripping resilient element 28' and a resilient element 56 that extends from the distal end 34' of handle 26' to provide a soft distal tip 32'. Toothbrush 10' does not include a large palm-gripping resilient area. Instead, a partial palm grip is provided by the rearwardly extending portions 58 of finger-gripping resilient element 28'. The toothbrush 10" that is shown in FIGS. 6–6B is similar to the toothbrush shown in FIGS. 1–2, except that the palm-gripping resilient element 30" does not extend over the palm-gripping region 14 of the top surface of the toothbrush. Instead, there is only a small grip 62 on this surface, which may include a company logo or other indicia (not shown) if desired. The palm-gripping resilient element 30" provides a gripping surface on the bottom surface of the toothbrush, and extends rearwardly to form a distal tip 32" as described above. Toothbrush 10" also includes ribs 64 on the areas of the resilient elements that will be gripped by the index finger and thumb during use. These toothbrush shapes have in common that they are shaped to fit the space created between a user's fingers and palm when the user's hand assumes its natural closed position (gripping nothing, in a loose fist).

Figure 7:
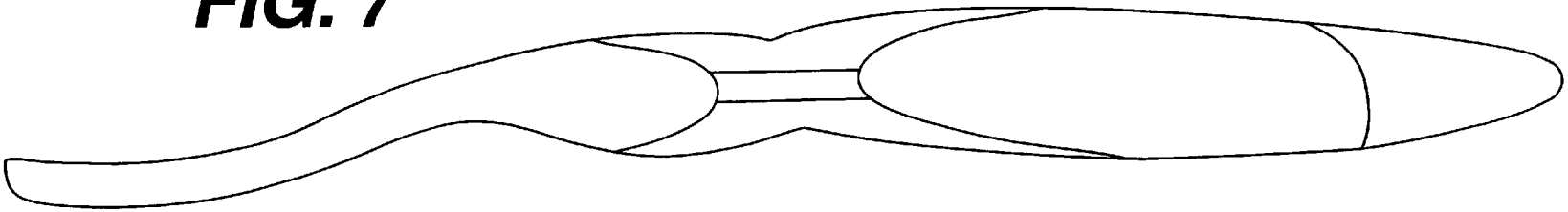
FIG. 7 is a side view of a toothbrush according to another alternate embodiment of the invention.
Figure 7A:
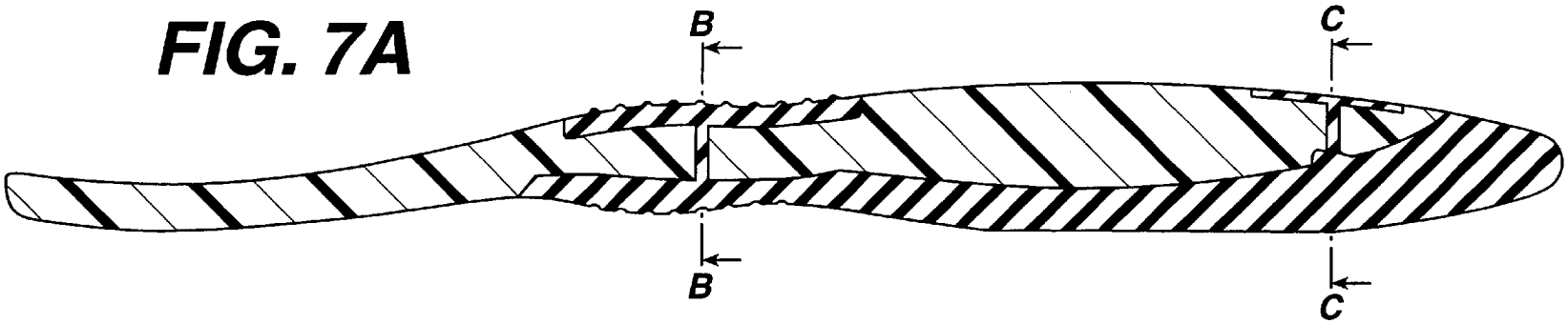
FIG. 7A is an axial cross-sectional view of the toothbrush of FIG. 7.
Figure 7C:
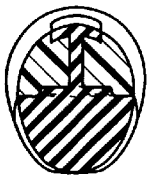
FIGS. 7B and 7C are radial cross-sectional views taken along lines B—B and C—C, respectively, in FIG. 7A.
Figure 7B:
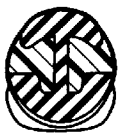

A toothbrush according to another alternate embodiment of the invention is shown in FIGS. 7–7C. These figures also show how the resilient elements may be molded to extend through the center of the handle. Molding the resilient elements in this manner can improve adhesion of the elastomer to the underlying handle by creating a mechanical bond in addition to the chemical/adhesive bond between the materials.

Materials

The resilient elements are formed of a resilient material, preferably a thermoplastic elastomer (TPE). Suitable TPEs include thermoplastic vulcanates (rubber polyolefin blends), polyetheramides, polyesters, styrene-ethylene-butylene-styrene (SEBS) block copolymers, styrene-butadiene-styrene block copolymers, partially or fully hydrogenated styrene-butadiene-styrene block copolymers, styrene-isoprene-styrene block copolymers, partially or fully hydrogenated styrene-isoprene-styrene block copolymers, polyurethanes, polyolefin elastomers, polyolefin plastomers, styrenic based polyolefin elastomers, compatible mixtures thereof, and similar thermoplastic elastomers. Preferred TPEs include styrene-ethylene-butylene-styrene (SEBS) block copolymers, styrene-butadiene-styrene block copolymers, partially or fully hydrogenated styrene-butadiene-styrene block copolymers, styrene-isoprene-styrene block copolymers, and partially or fully hydrogenated styrene-isoprene-styrene block copolymers, commercially available from Shell under the tradename KRATON rubber. Particularly preferred are styrene-ethylene-butylene-styrene (SEBS) block copolymers available from Shell under the tradename "G-Type" KRATON rubbers. The aforementioned TPEs may be modified with fillers such as talc, and with oil, which will generally reduce the hardness of the elastomer, as is well known in the art. Other suitable resilient materials include closed cell foams and resilient urethanes and silicones. Suitable closed cell foams include polyurethane foams, e.g., those prepared from compositions having two components: a foamable, curable polyurethane prepolymer, and an aqueous phase containing a latex and a surfactant. One of the two phases (or both) may also include a filler. Either phase can also include a conventional catalyst (or other reaction rate modifier) to either speed up or slow down the foaming reaction.

Preferred resilient materials are durable enough to withstand use during the lifetime of the brush without tearing or abrading, and hard enough to provide a secure-feeling grip, while also being sufficiently soft to provide a comfortable degree of cushioning during use. Preferred materials have a hardness of from about 3 to 90 Shore A, more preferably about 10 to 30 Shore A. It is also preferred that the resilient material have an elongation at break of at least 25%, more preferably from about 25 to 1100%, a tensile modulus of at least 50 psi, more preferably from about 80 to 1000 psi, and a tear strength of at least 50 pli, more preferably at least 75 pli.

Suitable materials for handle 26 include plastics that are sufficiently rigid so that the handle will not flex excessively during use. Preferably, the handle has a tensile modulus of at least 50,000 psi. Suitable materials include polypropylene, cellulose acetate proprionate and thermoplastic polyurethanes.

Manufacture

The toothbrush may be formed by any suitable method. For example, the resilient elements may be comolded with the handle or overmolded onto the handle during an injection molding process, or the handle may be injection molded and the resilient elements adhered to the handle in a subsequent manufacturing step. If comolding or overmolding is used, it is generally important that the polymer used to form the resilient elements be compatible with, and capable of adhering to, the polymer used to form the underlying handle. Suitable combinations of polymers are well known in the toothbrush art, e.g., polypropylene with KRATON block copolymer, and rigid urethane with polyurethane elastomer. It is generally advantageous to overmold the resilient polymer before the polymer used to mold the handle has completely cooled. Suitable overmolding techniques are disclosed, e.g., in U.S. Pat. No. 5,781,958, the full disclosure of which is incorporated herein by reference.

Other Embodiments

Other embodiments are within the claims. For example, the features described above can be used in other combinations, e.g., ribs can be provided on the resilient elements shown in FIGS. 1–2. Also, the resilient elements can be formed of more than one resilient material, e.g., using multi-shot molding the resilient elements can be provided with areas of relatively softer and harder material. For example, the palm-gripping resilient element may be molded of several resilient materials of progressively lower durometer, with the hardest material (e.g., 5 to 50 Shore A) being positioned closest to the finger-gripping region and the softest material (e.g., 0 to 30 Shore A) at the distal tip.

What is claimed is:

1. A toothbrush comprising:

a body and a brush head extending from the body, wherein the body comprises a handle having a distal end, a first resilient element mounted on the handle, a tapered distal tip of the first resilient element extending beyond the distal end of the handle, and a second resilient element constructed to provide a grip for the user's thumb and index finger during use.

2. The toothbrush of claim 1 wherein the body is contoured to provide a finger-gripping region, and a palm-gripping region having a relatively larger diameter than the finger-gripping region.

3. The toothbrush of claim 2 wherein the body has a maximum diameter at the approximate midpoint between the finger-gripping region and the distal end of the handle.

4. The toothbrush of claim 3 wherein the body has a thickest section equal to the length of the longest vertical line that connects the top and bottom functions that define the palm-gripping region, and the thickness of the thickest section of the body is about 0.5 to 1.0 inches.

5. The toothbrush of claim 4 wherein the thickest section of the body is located about 1.5 to 3 inches from the finger-gripping region.

6. The toothbrush of claim 2 wherein the body has a taper, from the larger diameter palm gripping region to the finger gripping region, that is defined by an angle $\alpha_1$ of from about 2 to 20 degrees, and an angle $\beta_1$ of from about 3 to 12 degrees, wherein angle $\alpha_1$ is measured counterclockwise from a central dissecting line $l_h$ to a top finger grip vertical elevation line $l_{\alpha 1}$, and wherein angle $\beta_1$ is measured clockwise from the central dissecting line $l_h$ to a bottom finger grip vertical elevation line $l_{\beta 1}$.

7. The toothbrush of claim 1 wherein the taper of the distal tip is defined by an angle $\alpha_2$ of from about 2 to 20 degrees, and an angle $\beta_2$ of from about 2 to 15 degrees, wherein angle $\alpha_2$ is measured clockwise from a central dissecting line $l_h$ to a distal tap vertical elevation line $l_{\alpha 2}$, and wherein angle $\beta_2$ is measured counterclockwise from a distal bottom elevation line $l_{\beta 2}$ to the central dissecting line $l_h$.

8. The toothbrush of claim 1 wherein the first resilient element comprises a resilient material selected from the group consisting of thermoplastic elastomers, closed cell foams, resilient urethanes and silicones.

9. The toothbrush of claim 8 wherein said resilient material comprises a thermoplastic elastomer selected from the group consisting of thermoplastic vulcanates (rubber polyolefin blends), polyetheramides, polyesters, styrene-ethylene-butylene-styrene (SEBS) block copolymers, styrene-butadiene-styrene block copolymers, partially or fully hydrogenated styrene-butadiene-styrene block copolymers, styrene-isoprene-styrene block copolymers, partially or fully hydrogenated styrene-isoprene-styrene block copolymers, polyurethanes, polyolefin elastomers, polyolefin plastomers, styrenic based polyolefin elastomers, and compatible mixtures thereof.

10. The toothbrush of claim 9 wherein said thermoplastic elastomer comprises a styrene-ethylene-butylene-styrene block copolymer.

11. The toothbrush of claim 1 wherein the length of said distal tip is about 0.025 to 2.0 inches.

12. The toothbrush of claim 1 wherein said first resilient element comprises a resilient material having an elongation at break of from about 25% to 1100%.

13. The toothbrush of claim 1 wherein said first resilient element comprises a resilient material having a hardness of from about 3 to 90 Shore A.

14. The toothbrush of claim 1 wherein said first resilient element comprises a resilient material having a tensile modulus of at least 50 psi.

15. The toothbrush of claim 1 wherein said first resilient element comprises a resilient material having a tear strength of at least 50 pli.

16. The toothbrush of claim 1 wherein said distal tip is generally oval in cross-section.

17. The toothbrush of claim 1 wherein said body is generally bulbous shaped.

18. The toothbrush of claim 1 wherein said body is generally hour-glass shaped.

19. The toothbrush of claim 1 wherein said first resilient element provides a gripping surface for the palm of the user's hand during use.

20. The toothbrush of claim 1 wherein said body has a maximum circumference $C_2$ of from about 1.5 to 3.0 inches.

21. The toothbrush of claim 1 wherein said body has a minimum circumference $C_1$ of from about 0.6 to 3.0 inches.

22. The toothbrush of claim 1 wherein said distal tip is generally elliptical in cross-section.

23. A toothbrush comprising:

a body and a brush head extending from the body, wherein the body comprises a handle having a distal end and a resilient element mounted on the handle, a tapered distal tip of the resilient element extending beyond the distal end of the handle, and wherein the taper of the distal tip is defined by an angle $\alpha_2$ of from about 2 to 20 degrees, and an angle $\beta_2$ of from about 2 to 15 degrees, wherein angle $\alpha_2$ is measured clockwise from a central dissecting line $l_h$ to a distal top vertical elevation line $l_{\alpha 2}$and wherein angle $\beta_2$ is measured counterclockwise from a distal bottom elevation line $l_{\beta 2}$ to the central dissecting line $l_h$.

24. The toothbrush of claim 23 wherein the body is contoured to provide a finger-gripping region, and a palm-gripping region having a relatively larger diameter than the finger-gripping region.

25. The toothbrush of claim 24 wherein the body has a taper, from the larger diameter palm gripping region to the finger gripping region, that is defined by an angle $\alpha_1$ of from about 2 to 20 degrees, and an angle $\beta_1$ of from about 3 to 12 degrees, wherein angle $\alpha_1$ is measured counterclockwise from a central dissecting line $l_h$ to a top finger grip vertical elevation line $l_{\alpha 1}$, and wherein angle $\beta_1$ is measured clockwise from the central dissecting line $l_h$ to a bottom finger grip vertical elevation line $l_{\beta 1}$.

26. A method of cleaning the teeth comprising providing a toothbrush comprising a body and a brush head extending from the body, wherein the body comprises a handle having a distal end, a first resilient element mounted on the handle, a tapered distal tip of the first resilient element extending beyond the distal end of the handle, and a second resilient element constructed to provide a grip for the user's thumb and index finger during use; and brushing the teeth with said toothbrush.

27. A toothbrush comprising:

a body and a brush head extending from the body, wherein the body comprises a handle having a distal end, a resilient element mounted on the handle, a tapered distal tip of the resilient element extending beyond the distal end of the handle, and wherein the body includes a palm-gripping area having a generally arcuate profile when the toothbrush is viewed from the side.

28. A toothbrush comprising:

a body and a brush head extending from the body, wherein the body is contoured to provide a finger-gripping region, and a palm-gripping region having a relatively larger diameter than the finger-gripping region, and the body comprises a handle having a distal end and a resilient element mounted on the handle, a tapered distal tip of the resilient element extending beyond the distal end of the handle, and wherein the body has a taper, from the larger diameter palm gripping region to the finger gripping region, tat is defined by an angle $\alpha_1$ of from about 2 to 20 degrees, and an angle $\beta_1$ of from about 3 to 12 degrees, wherein angle $\alpha_1$ is measured counterclockwise from a central dissecting line $l_h$ to a top finger grip vertical elevation line $l_{\alpha 1}$, and wherein angle $\beta_1$ is measured clockwise from the central dissecting line $l_h$ to a bottom finger grip vertical elevation line $l_{\beta 1}$.

* * * * *

UNITED STATES PATENT AND TRADEMARK OFFICE

CERTIFICATE OF CORRECTION

PATENT NO. : 6,298,516 B1
DATED : October 9, 2001
INVENTOR(S) : Donna Beals et al.

It is certified that error appears in the above-identified patent and that said Letters Patent is hereby corrected as shown below:

Title page,
Item [56], U.S. PATENT DOCUMENTS, replace “Darcissic” with -- Darcissac --.
FOREIGN PATENT DOCUMENTS, replace “11/1981” with -- 1/1981 --.

Column 9,
Line 35, replace “pli” with -- psi --.

Column 10,
Line 50, replace “tat” with -- that --.

Signed and Sealed this

Twenty-eighth Day of January, 2003

JAMES E. ROGAN
*Director of the United States Patent and Trademark Office*